US005961111A

United States Patent [19]

Kurata et al.

[11] Patent Number: 5,961,111

[45] Date of Patent: Oct. 5, 1999

[54] SHEET FEEDING DEVICE FOR A DUPLEX IMAGE FORMING APPARATUS

[75] Inventors: Norimasa Kurata, Fukuyama; Hideo Taniguchi; Masahiko Fujita, both of Nara; Norio Hontani, Fukayasu-gun; Daigo Nishioka, Fukuyama; Keigo Hashimoto, Fuchu; Hitoshi Nishida, Fukayasu-gun; Nobuhiko Sakamoto, Mitsugi-gun; Tatsuya Seo, Fukuyama; Kiyohide Ochi, Fukayasu-gun; Hideaki Sugata, Fukuyama; Hideyuki Kamiura, Ashina-gun, all of Japan

[73] Assignee: Sharp Kabushiki Kaisha, Osaka, Japan

[21] Appl. No.: 08/936,437

[22] Filed: Sep. 24, 1997

[30] Foreign Application Priority Data

Oct. 29, 1996 [JP] Japan ..... 8-285739
Nov. 1, 1996 [JP] Japan ..... 8-291340

[51] Int. Cl.[6] ..... B65H 5/22

[52] U.S. Cl. ..... 271/3.03; 271/3.05; 271/188; 271/220; 399/402

[58] Field of Search ..... 399/402, 406; 271/3.02, 3.03, 3.05, 270, 188, 182, 220, 221

[56] References Cited

U.S. PATENT DOCUMENTS

| | | | |
|---|---|---|---|
| 4,272,180 | 6/1981 | Satomi et al. | 271/3.03 |
| 4,838,539 | 6/1989 | Zimmermann | 271/220 |
| 4,869,488 | 9/1989 | Hirota et al. | 271/3.02 |
| 5,580,041 | 12/1996 | Nakayama | 271/220 |

*Primary Examiner*—H. Grant Skaggs

[57] ABSTRACT

The intermediate sheet feeding device for a duplex image forming apparatus includes: an intermediate tray; an sheet input conveyance path to the intermediate tray; a sheet output conveyance path from the intermediate tray; the sheet input conveyance path and the sheet output conveyance path being arranged to intersect each other at one end of the intermediate sheet tray; a conveying roller provided along the conveyance path from the image processing portion to the intermediate tray; and a conveyance controlling means which controls the conveying roller so as to convey the sheet at a speed lower than that when the sheet advances through the image processing portion and so that a short-sized sheet is conveyed slower than a long-sized sheet. Further, a configuration for preventing sheet curl includes: a presser member for pressing the rear end of a sheet input above the intermediate tray against the intermediate tray; and a lift stopper member pivotally supported at an axle below the input roller so as to inhibit the pop-up of the rear ends of sheets.

8 Claims, 12 Drawing Sheets

SHEET FEEDING DEVICE FOR A DUPLEX IMAGE FORMING APPARATUS

BACKGROUND OF THE INVENTION (1) Field of the Invention

The present invention relates to a sheet re-feeding device which first collects sheets having an image formed thereon and sends out the collected sheet again to the image forming station in order to effect duplex printing of the undersurface of, or superimposition printing of the same surface of, the sheet having an image formed thereon.

(2) Description of the Prior Art

Conventionally, it has been well known that duplex copy print can be obtained by a duplication technique, such as an electrophotographic process etc. This duplex printing of images on both sides of a sheet is performed by a process comprising the steps of: forming a static latent image on the photoreceptor and developing it into a toner image; transferring the toner image to a sheet of paper and fixing it on the sheet; collecting the sheet with the image formed on the first side into the intermediate tray; forming another static latent image on the photoreceptor and developing it into a toner image; and transferring the toner image to the second side of the sheet and fixing it on the sheet.

In an automatic duplex printing copier, when duplex printing of images are formed as above, a desired number of sheets with images printed on the first side thereof are collected on an intermediate tray, then the sheets on the intermediate tray are delivered out sheet by sheet while an image to be printed on the second side of the sheet is being formed on the photoreceptor so that the image is transferred to the second side of the sheet. This is a known method of duplex image forming for a multiple number of sheets, and is called a multi-copying method.

On the other hand, there is another method for duplex printing. This method is performed by forming an image on the first side of a sheet of paper, then collecting the sheet into an intermediate tray and directly re-feeding the sheet with one side printed so as to form another image on the second side. This operation will be repeated as required to obtain a multiple number of duplex copies. This method is known as a sequential copying method.

As an example of an automatic duplex image forming apparatus using the multi-copying method, it has been disclosed in Japanese Patent Application Laid-Open Sho 57 No.72,537, that in order to carry out duplex copying, when a multiple number of sheets are collected on the duplex printing sheet receptacle, the sheets are pressed from above whenever a sheet is stacked thereon in a way that makes it possible to perform stable sheet feeding even when curled sheets are stacked therein.

Further, it is disclosed in Japanese Patent Application Laid-Open Sho 61 No.140,425 that a sheet entering the tray of a duplex copying tray device is alternately pressed down at its rear end by a rear end presser and at its front end by a front end presser to correct rear and front end curls respectively, so as to prevent a following sheet from clashing with the sheets inside the tray and hence causing jamming.

In these conventional techniques, a sheet inverting mechanism was provided in such a manner that when a sheet is inverted and enters the intermediate tray to print an image on the second side of the sheet, the sheet is conveyed in a direction across that in which the sheet is conveyed through the transfer portion. This geometry made the apparatus large.

Specifically, in conventional configurations, the sheet which underwent the first copying operation tends to be set curled by the heating or pressing process of the fixing device and the inverting portion provided on its downstream side with respect to the sheet conveying direction. When such a sheet was accommodated in the duplex printing tray unit, the sheet would become bent or curled cylindrically resulting in improper accommodation, and hence the sheet could not be fed correctly for the second copying operation.

Referring further to the problems of the conventional art, in an image forming apparatus, when a sheet having an image formed thereon is input into the intermediate tray, the sheet often becomes curled across its width or length. The degree of curling is not equal and depends upon the individual sheets. Therefore, the front or rear end of an already accommodated sheet in the intermediate tray frequently snags or catches the front or rear end of a following sheet, causing sheet jams.

As means for solving the above problem, a protection device has been proposed in Japanese Patent Publication Hei 5 No.50,433. In this disclosure, in order to prevent the front end of a sheet being input to the intermediate tray from being snagged by the rear end of the already collected sheet in the intermediate tray, the rear end of the collected sheet is adapted to be pressed down from above. Then, at the timing when the front end of the sheet reaches the front end of the intermediate tray with respect to the sheet feeding direction, the front end of the already collected sheet is adapted to be pressed down, thus preventing the currently input sheet from being snagged with the already collected sheet and achieving a smooth input of sheets to the intermediate tray.

Therefore, the mechanism for pressing down the front and rear ends of sheets from above in the intermediate tray, disclosed in Japanese Patent Publication Hei 5 No.50,433, is constructed of a pair of front and rear end curl pressers which alternately move up and down.

In an image forming apparatus, in order to first collect a sheet having an image formed thereon and re-feed the collected sheet to the image forming station, it is necessary to solve the problem of sheet curling. However, in the mechanism disclosed in Japanese Patent Publication Hei 5 No.50,433, the device for inputting sheets into the intermediate tray becomes bulky. More specifically, before the front end of the sheet enters the intermediate tray, the entrance of the sheet should be detected so as to operate the rear end curl presser member, and then, before the front end of the sheet reaches the front end of the intermediate tray with respect to the sheet feeding direction, the state of the sheet should be detected so as to operate the front end curl presser member. In this way, this device needs a very bulky and complicated configuration for its control and mechanism and its controller circuit etc. Therefore, this configuration is extremely high in cost as a sheet re-feeding device containing an intermediate tray.

Further, the sheets once collected in the intermediate tray will cause improper sheet feeding when they are re-fed therefrom due to their differences in the curl direction and degree of curl.

For example, as shown in FIG. 1, a sheet P having an image formed thereon is conveyed by means of a conveyer roller 61 provided in the conveyance path 60 into an intermediate tray 62 disposed in the lower portion. When the front end of sheet P abuts an unillustrated limiting plate in intermediate tray 62, the conveyance of the rear end of the sheet by conveyer roller 61 completes and sheet P will be stacked due to gravity onto intermediate tray 62. At this moment, if the rear end of sheet P is curled, a presser member 63 located thereabove is rotated about an axle 63*a* toward the intermediate tray to press the rear end of curled sheet P down to the placement face of intermediate tray 62.

In the figure, 64 designates a sheet feed roller for feeding the lowermost one of stacked sheets P; 65 a delivering roller for delivering the sheet fed by sheet feed roller 64 to conveyance path 67 which is connected to the image forming station; 66 a separation roller which stops the delivery of the upper sheets except the sheet to be delivered by the delivering roller to achieve a single sheet delivery; and 68 and 69 designate respectively an actuator that operates under sheets P stacked on intermediate tray 62 and an optical sensor, constituting a sheet detecting means for detecting the existence of sheets.

After presser member 63 presses down the curled sheet, the presser member 63 should be reverted back to an unillustrated upper position in order to receive the subsequent sheet. At this moment, if the sheet has a strong rigidity and has been strongly curled, the sheet tends to revert back to the curled state or the rear end of the sheet pops up to a position where the front end of a subsequent sheet P will be conveyed by conveyer roller 61 and hence the curled sheet will snag the front end of sheet P being conveyed, causing a sheet jam when it is input into intermediate tray 62.

Further, even if the sheet is pressed down by sheet presser member 63, the rear end of the sheet might snag the slanted sheet guide surface as shown in FIG. 1. If the sheet in this state is re-fed in the opposite direction by sheet feed roller 64 and delivering roller 65, a delivery failure will occur.

Moreover, as the stacked number of sheets P in intermediate tray 62 is increased, the bottom becomes raised in proportion to the thickness of the sheets, the rear end of the sheets rises to a position where they hinder a following sheet P entering intermediate tray 62 even when the rear end of the sheets accommodated in intermediate tray 62 are pressed down by presser member 63. Therefore, it is necessary to limit the number of sheets held in intermediate tray 62.

As shown in FIG. 2, when a plurality of sheets P are accommodated being stacked on intermediate sheet tray 62, the degree of curling will be different in individual sheets. In such a case, a subsequent sheet P being input into intermediate tray 62 will push a previously accommodated sheet P1 toward a sheet stopper member 70, failing to align the front ends of the sheets flush with each other. Therefore, the rear ends of the sheets are displaced proportionally from the position of sheet feed roller 64, causing sheet delivery failure when a sheet is re-fed.

SUMMARY OF THE INVENTION

The present invention has been devised to solve the above problems, it is therefore an object of the present invention to provide a compact device which inverts a sheet and collects it in an intermediate tray in order to form an image on a second side of the sheet, wherein the conveying speed of sheets is set lower for a shorter sheet than for a longer sheet.

It is another object of the invention to provide a sheet re-feeding device which has an extremely simple structure and still can eliminate malfunctions such as jams, improper feeding and the like of sheets which are input into an intermediate tray for re-feeding sheets.

It is still another object of the invention to provide an extremely simple structure which can definitely avoid hindrance of previously collected sheets in an intermediate tray against a subsequently input sheet regardless of sheet curling.

The present invention has been achieved to attain the above objects and the gist is as follows:

In accordance with the first aspect of the invention, an intermediate sheet feeding device for a duplex image forming apparatus, which makes an image processing portion form an image on one side of a sheet, collects the sheet with an image formed on one side thereof in an intermediate tray, and re-feeds the one side printed sheet to form an image on the other side thereof, includes:

an intermediate tray;

an sheet input conveyance path to the intermediate tray;

a sheet output conveyance path from the intermediate tray; the sheet input conveyance path and the sheet output conveyance path being arranged to intersect each other at one end of the intermediate sheet tray;

a conveying roller provided along the conveyance path from the image processing portion to the intermediate tray; and a conveyance controlling means which controls the conveying roller so as to convey the sheet at a speed lower than that when the sheet advances through the image processing portion and so that a short-sized sheet is conveyed slower than a long-sized sheet.

In accordance with the second aspect of the invention, an intermediate sheet feeding device for a duplex image forming apparatus, which makes an image processing portion form an image on one side of a sheet, collects the sheet with an image formed on one side thereof in an intermediate tray, and re-feeds the one side printed sheet to form an image on the other side thereof, includes:

an intermediate tray;

an sheet input conveyance path to the intermediate tray;

a sheet output conveyance path from the intermediate tray; the sheet input conveyance path and the sheet output conveyance path being arranged to cross each other at one end of the intermediate sheet tray;

a conveying roller provided along the conveyance path from the image processing portion to the intermediate tray; and a curl correction portion between the conveying roller and the image processing portion, and is characterized in that the limiting position of sheets when sheets are input into the intermediate tray is shifted by a prescribed distance from the position for the inherent length of the sheets in the sheet re-feeding direction so as to regulate the sheets during the sheet input operation as well as during the sheet re-feeding operation.

In accordance with the third aspect of the invention, an intermediate sheet feeding device for a duplex image forming apparatus has the above second feature, further comprises a conveyance controlling means which controls the conveying roller so as to convey the sheet at a speed lower than that when the sheet advances through the image processing portion and so that a short-sized sheet is conveyed slower than a long-sized sheet.

In accordance with the fourth aspect of the invention, an intermediate sheet feeding device for a duplex image forming apparatus, which makes an image processing portion form an image on one side of a sheet, collects the sheet with an image formed on one side thereof in an intermediate tray, and re-feeds the one side printed sheet to form an image on the other side thereof, includes:

a sheet input roller for inputting the sheet with an image formed thereon into the intermediate tray;

a presser member for pressing down the sheet input by the sheet input roller at one end thereof onto the intermediate tray; and a lift stopper member disposed at a position below the sheet input roller and corresponding to one end of the input sheet to be collected in the intermediate tray and operating so as to be positioned on the top of the sheet end when the sheet presser presses down the end of the sheet.

In accordance with the fifth aspect of the invention, an intermediate sheet feeding device for a duplex image forming apparatus has the fourth feature and is characterized in that the lift stopper member has a lift stopper portion which is pivotally provided at an axle and sways when one end of the sheet is pressed down and which is positioned so that the sheet end stays therebeneath when the lift stopper portion reverts back to the original position.

In accordance with the sixth aspect of the invention, an intermediate sheet feeding device for a duplex image forming apparatus has the above fifth feature and is characterized in that the lift stopper member has a balancer portion which sets the center of gravity of the lift stopper member toward the opposite side of the lift stopper member so that the lift stopper member will revert back to the original position after it is pressed down by one end of a sheet.

In accordance with the seventh aspect of the invention, an intermediate sheet feeding device for a duplex image forming apparatus has the above fourth feature and is characterized in that the presser member has a presser end pressing down one end of sheets and a presser roller for pressing the collected sheets against a sheet feed roller for re-feeding the sheets collected in the intermediate tray.

In the sheet feeding device for a duplex image forming apparatus, sheet curl is corrected in such a manner that the conveying speed of the input roller device of the duplex printing tray unit is differentiated from the conveying speed of the inverting unit in inverting portion provided downstream, with respect to the sheet conveying direction, of the fixing unit, depending upon the size of sheets to be conveyed, so as to push the sheet from the rear end side thereof and create curl (with the imaged side concave) which is opposite to the curled direction of the inverting portion (where the imaged side is convex) using the sheet bending portion along the conveyance path.

In the above configuration, the present invention has the following characteristic features. When the sheet is long, the conveying roller before the duplex unit is driven at a second speed (V2) which is slightly lower than the first speed (V1) at which the sheet is conveyed by the fixing unit. This setting causes the sheet to be gradually curled between the fixing unit and the conveying roller before the duplex unit.

On the other hand, when the sheet is short, the conveying roller before the duplex unit is driven at a third speed (V3) which is lower than the first speed (V1) at which the sheet is conveyed by the fixing unit and is lower than the second speed (V2) for conveying a long sheet. In this setting, the short sheet will be curled to a required amount faster than the long sheet, between the fixing unit and the conveying roller before the duplex unit.

In this way, since the conveying speed is made lower for a short sheet than a long sheet, it is possible to create a prescribed amount of curl at the rear end of the sheet with respect to the conveying direction, even if the length of sheets changes.

Further, for a long sheet, it is possible to gently correct the curl of the sheet at the front end and concentratedly create strongly curl corrected portion at the rear end of the sheet.

In accordance with the sheet feeding device for duplex image forming apparatus, the duplex tray unit has a rear end plate for aligning the input sheets stacked thereon. The rear end plate is located at a position farther with respect to the sheet input direction before the sheet is input, and moves to a position corresponding to the length of the sheet from the sheet front end adjuster after the sheet has been input. This operation aligns the stacked sheets flush with each other in the duplex printing tray unit.

However, when a collected sheet in the duplex printing tray unit has a curl, the length of the sheet is substantially shorter than the nominal length of the sheet due to curl. Therefore, even if the rear end plate is shifted to a position corresponding to the length of the sheet from the sheet front end adjuster after the sheet has been input, it is impossible to produce appropriate alignment of the sheets.

In order to solve this problem, reduction of the sheet in its length in the sheet conveying direction due to sheet curling is measured previously, and the rear end plate is set up so as to move by the distance of the reduction from the nominal position of the front end of the sheet with respect to the sheet conveying direction to a displaced position in the direction of sheet re-feeding. This setting enables appropriate alignment of sheets.

Further, in the above featured configuration, if the sheet end tends to be raised due to curl, the curl can be regulated by the sheet lift stopper member. Accordingly, no failure such as the rear end of the sheets already stacked snag the front end of a sheet being input by the input roller will happen.

In the above featured configuration, it is possible to reliably prevent the sheet from popping at its end and hence reliably input the sheet into the intermediate tray by an extremely simple configuration of the lift stopper member.

Moreover, in the above feature, it is possible to press down the sheets at its one end simultaneously by using the mechanism for pressing the presser roller in contact with the sheet feed roller. This configuration markedly simplifies the mechanism and also makes it possible to deliver the sheet accommodated in the intermediate tray simultaneously with the pressing of the sheet at its one end.

DESCRIPTION OF THE PREFERRED EMBODIMENTS

First an overall configuration of a copier as an image forming apparatus will be described with reference to FIG. 3. The sheet feeding device of the invention can not only be applied to copiers but of course to printers etc., which need duplex printing or superimposition printing of an image on the same surface.

Figure 1:
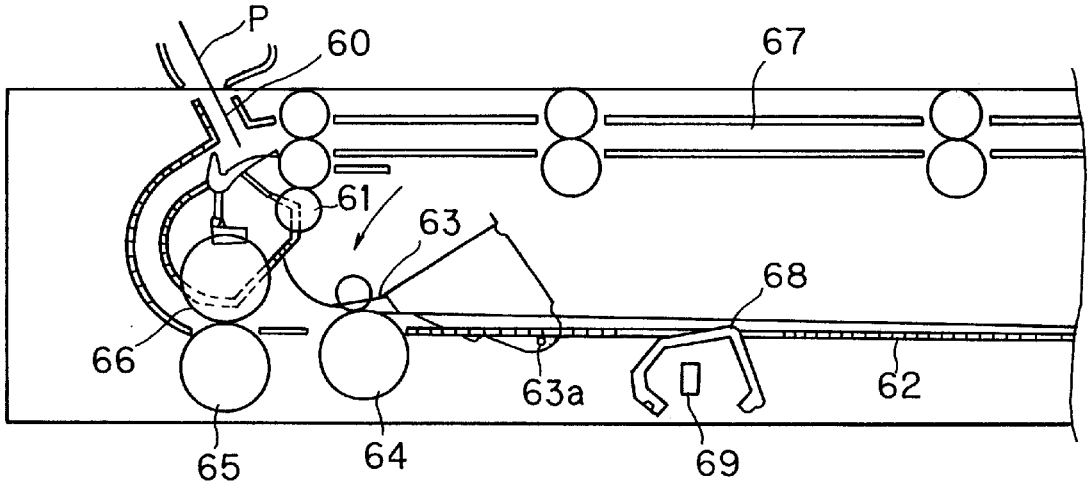
Fig.1 PRIOR ART
FIG. 1 is a diagram showing a problem of a conventional sheet re-feeding device.
Figure 2:
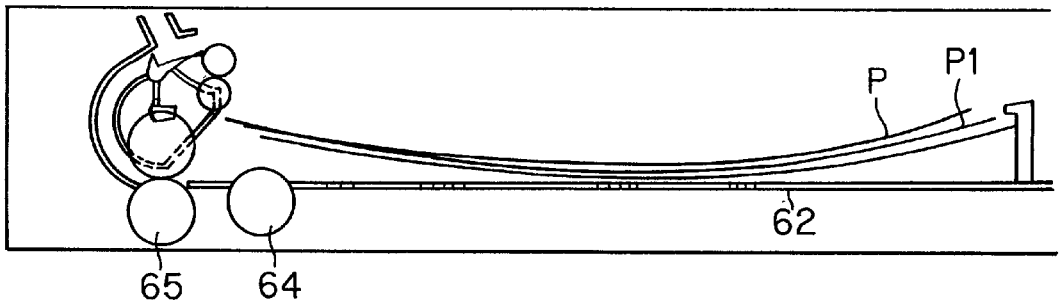
Fig.2 PRIOR ART
FIG. 2 is a diagram showing another problem of a conventional sheet re-feeding device.
Figure 3:
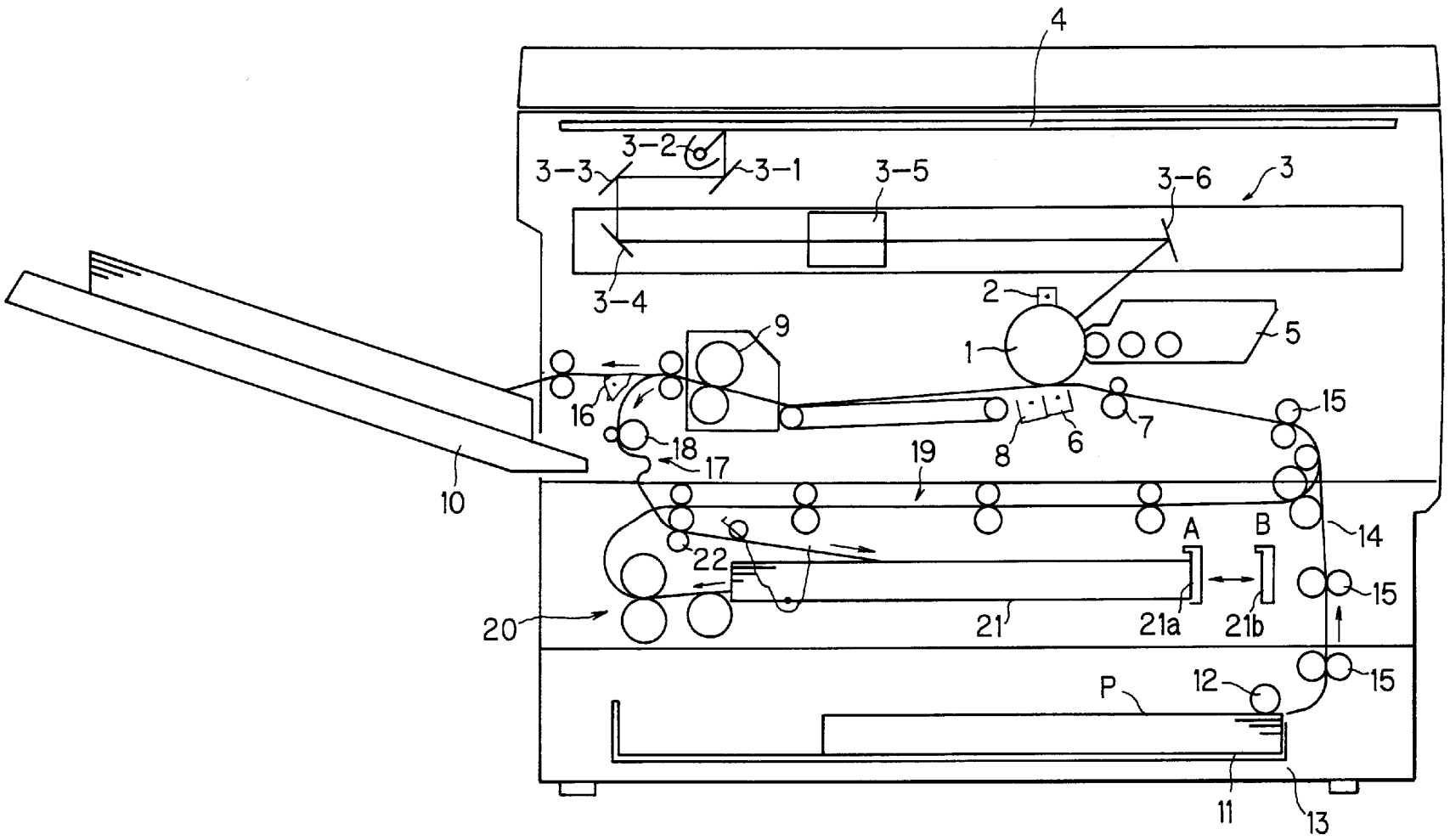
FIG. 3 is a sectional view showing the interior configuration of a copier as an example of an image forming apparatus having a sheet re-feeding device of the invention.

In FIG. 3, the copier has an image forming portion composed of, in its center, a photoreceptor 1 which rotates in a direction indicated by the arrow, a main charger 2 uniformly charging the photoreceptor surface; a developing unit 5 for developing the electrostatic latent image which has been formed on the photoreceptor by illuminating the image of the original placed on an original table 4 through an optical system 3; a transfer device 6 for transferring the toner image formed on the photoreceptor surface to a sheet which has been fed by the sheet feeding device; a cleaning unit (not shown) for removing leftover toner after transfer; and the like.

Optical system 3 for illuminating the image of the original so as to expose photoreceptor 1 to the reflected light includes: a scanner composed of an exposure lamp 3-1 disposed below original table 4 for illuminating the original and mirrors 3-2, 3-3 and 3-4 which properly reflect the reflected light from the original; a lens 3-5 focusing the reflected light from the original onto the surface of photoreceptor 1; and a fixed reflection mirror 3-6 which finally conducts the reflected light from the original through a lens onto photoreceptor 1. Accordingly, the first scanner portion composed of mirror 3-2 and exposure lamp 3-1 as part of the scanner is made to travel at a uniform speed along original table 4, while the second scanner portion composed of mirrors 3-3 and 3-4 is made to travel in the same direction as the first scanner portion but at half the speed of that of the first scanner portion. By this operation, the image on the original can be sequentially exposed slit-wise to light as photoreceptor 1 rotates, making it possible to create a focused image of the original image onto the surface of photoreceptor 1.

When the original image is illuminated by optical system 3, a static latent image in accordance with the original image is formed on the surface of photoreceptor 1 which has been uniformly charged by main charger 2. This static latent image is developed in the next step, i.e., developing unit 5, where toner as a coloring agent is made to adhere so as to create a visual image.

The toner image created on the surface of photoreceptor 1 is transferred to sheet P which is being conveyed properly from the sheet feeding device, by the action of transfer device 6. The sheet has been previously conveyed up to the position of a resist roller 7, and is delivered out by resist roller 7 to the transfer station (image forming station) facing to transfer device 6, at the timing in synchronization with the rotary movement of photoreceptor 1.

The sheet after transfer is separated from the surface of photoreceptor 1 by the action of a separator 8, and then is conveyed along the guide surface to heat fixing roller 9. As passing through heat fixing roller 9, the toner image formed on the sheet is fixed as a permanent image. Thereafter the sheet is discharged onto a sheet output tray 10 which is projected out from the machine body.

Next, the sheet feeding device for feeding sheets to resist roller 7 will be described. The sheet feeding device comprises a cassette feeder portion 13 which is disposed in the lower part of the copier body and is composed of a sheet cassette 11 which can be detachably fitted to the machine body (can be withdrawn in the planer direction in the drawing) and a sheet feed roller 12 for delivering sheets P accommodated in the feed cassette.

Sheet P delivered out from the sheet feeding device, specifically from cassette feeder portion 13, is conveyed to resist roller 7 in the direction shown by the arrow by means of several conveyer rollers 15 provided along a conveyance path 14.

On the other hand, sheet P thus having an image formed thereon is conveyed to either sheet output tray 10 or to a sheet re-feeding device 20 of this invention by changing the sheet conveying direction by means of a switching gate 16 which is provided between fixing roller 9 and output tray 10. An inverting path 17 provided for effecting duplex printing of images on a sheet branches from the sheet discharging path to sheet output tray 10 at that switching point so that the sheet can be conveyed to the sheet re-feeding device 20.

A conveyer roller 18 is provided along inverting path 17 to input the sheet to sheet re-feeding device 20. As shown in FIG. 3, sheet P is delivered out from cassette feeder portion 13, passed through conveyance path 14 and temporarily stopped at resist roller 7, and is sent to the transfer station at the timing synchronized with the rotation of photoreceptor 1. Sheet P separated from photoreceptor 1 by the action of separator 8 is progressively discharged to sheet output tray 10 by way of fixing roller 9. Sheets P are thus fed and conveyed along the path shown by the solid line and successively stacked onto sheet output tray 10.

When duplex printing of images is performed on a sheet, sheet P having passed through fixing roller 9 is led by switching gate 16 to enter inverting path 17 and input into re-feeding device 20. Then, sheet P is sent out from re-feeding device 20, in the opposite direction to that in which it has been input thereinto, to a re-conveyance path 19 arranged between re-feeding device 20 and the image forming portion. This re-conveyance path 19 is joined to conveyance path 14 at a point before resist roller 7. Therefore, sheet P delivered from re-feeding device 20 is made to stand by at resist roller 7 with its rear surface facing up. Here, whenever a sheet of paper P is input into a duplex printing tray unit 21, rear end plate 21*a* moves in the sheet conveyed direction. In this case, rear end plate 21*a* is located at a middle position B in FIG. 3 right before sheet P is input into duplex printing tray unit 21, and when the sheet P is input into duplex printing tray unit 21, rear end plate 21*a* moves to a position A. This movement aligns the ends of sheets P stacked on the tray flush with each other.

(Embodiment 1)

Figure 4:
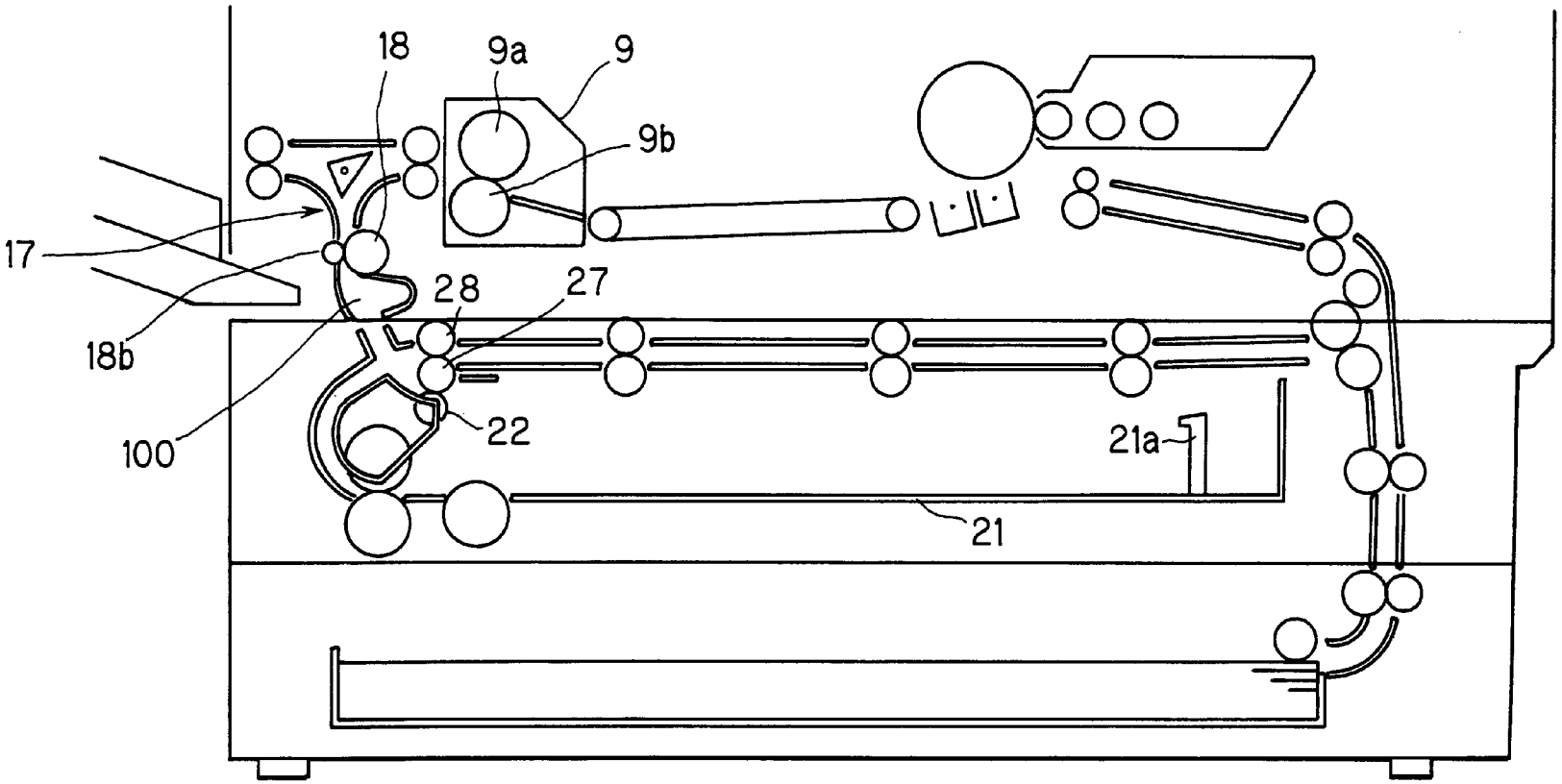
FIG. 4 is a diagram showing a configuration around a duplex printing tray unit of the invention.

Referring to FIG. 4, the characteristics of the operation of the invention will be described.

When the sheet heated by fixing rollers 9*a* and 9*b* passed through de-curler rollers 18 and 18*b* for removal of curling are provided as conveyor rollers downstream with respect to the sheet conveying direction of fixing unit 9, the sheet will become curled with its imaged side convex.

Figure 5:
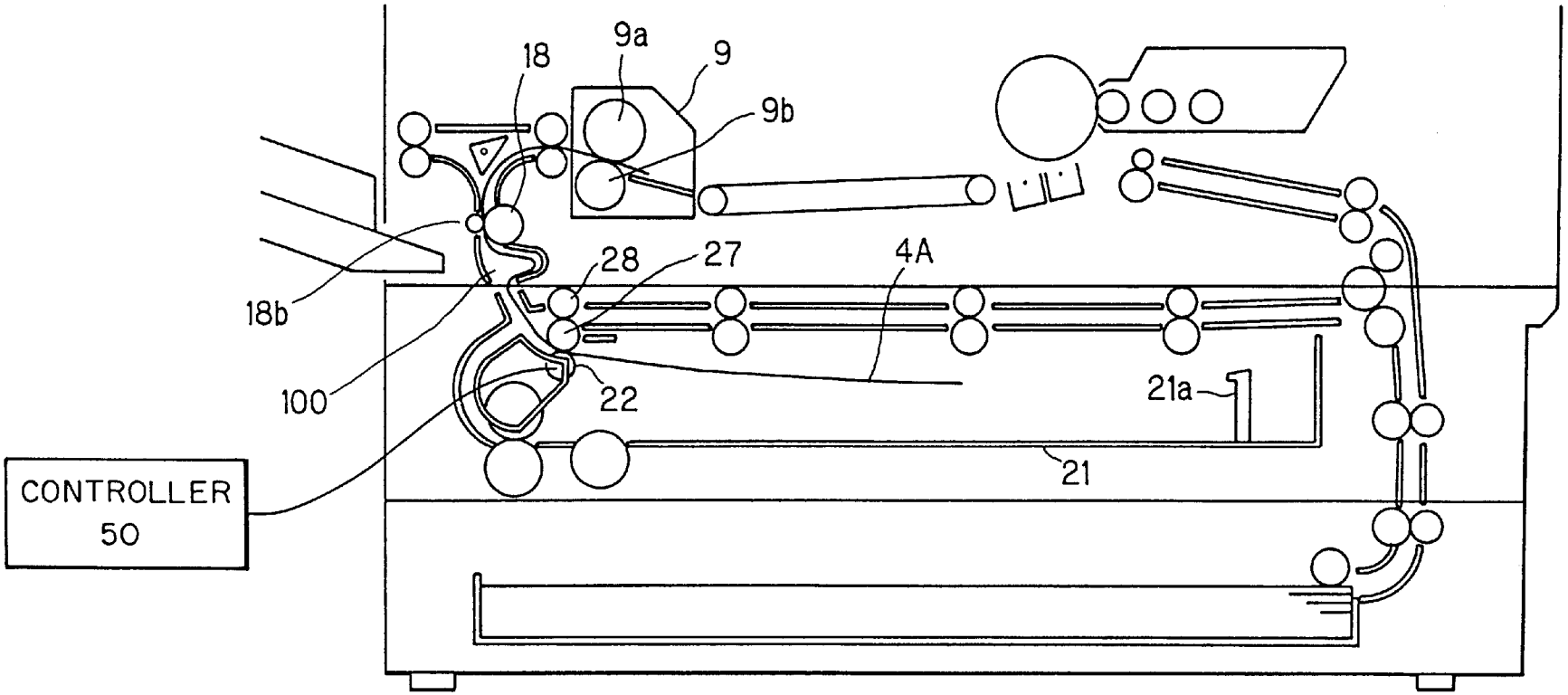
FIG. 5 is a diagram showing the operation with a sheet 4A in embodiment 1.

This can be avoided as follows: when an A-sized sheet 4A (its length in the conveying direction :L1) is conveyed along the path between de-curler rollers 18 and 18b and a sheet input device of rollers 27 and 22 to duplex printing tray unit 21 as an intermediate tray, the conveying speed of the sheet input device of rollers 27 and 22 is set at V1 which is lower than the conveying speed V0 (constant) of de-curler rollers 18 and 18*b* (V1<V0), so that the sheet residing between de-curler rollers 18, 18*b* and the sheet input device of rollers 27, 22 will become curled toward a sheet bending portion 100, which sets the sheet to be curled in the opposite direction of the curl formed by inverting path 17 (with its imaged side concave as shown in FIG. 5).

When the sheet is nipped by the sheet input device of rollers 27 and 22, the thus formed curl by sheet bending portion 100 is opposite that formed by inverting path 17, growing greater in its bending amount in proportion to the sheet conveyance time (or sheet length) due to the difference in conveying speed between the two sets of rollers. This flexure of the sheet propagates toward the rear end of the sheet as it is conveyed, thus correcting the curl of the sheet. In this way, when the sheet has passed de-curler rollers 18, 18*b* and a sheet input device of input rollers 27, 22 and has gotten through to the intermediate tray, the degree of the curl in the rear end portion of the sheet (pop-up at the rear end) on the intermediate tray can be significantly reduced as compared to the configuration having no bending portion with no difference in conveying speed.

Figure 6:
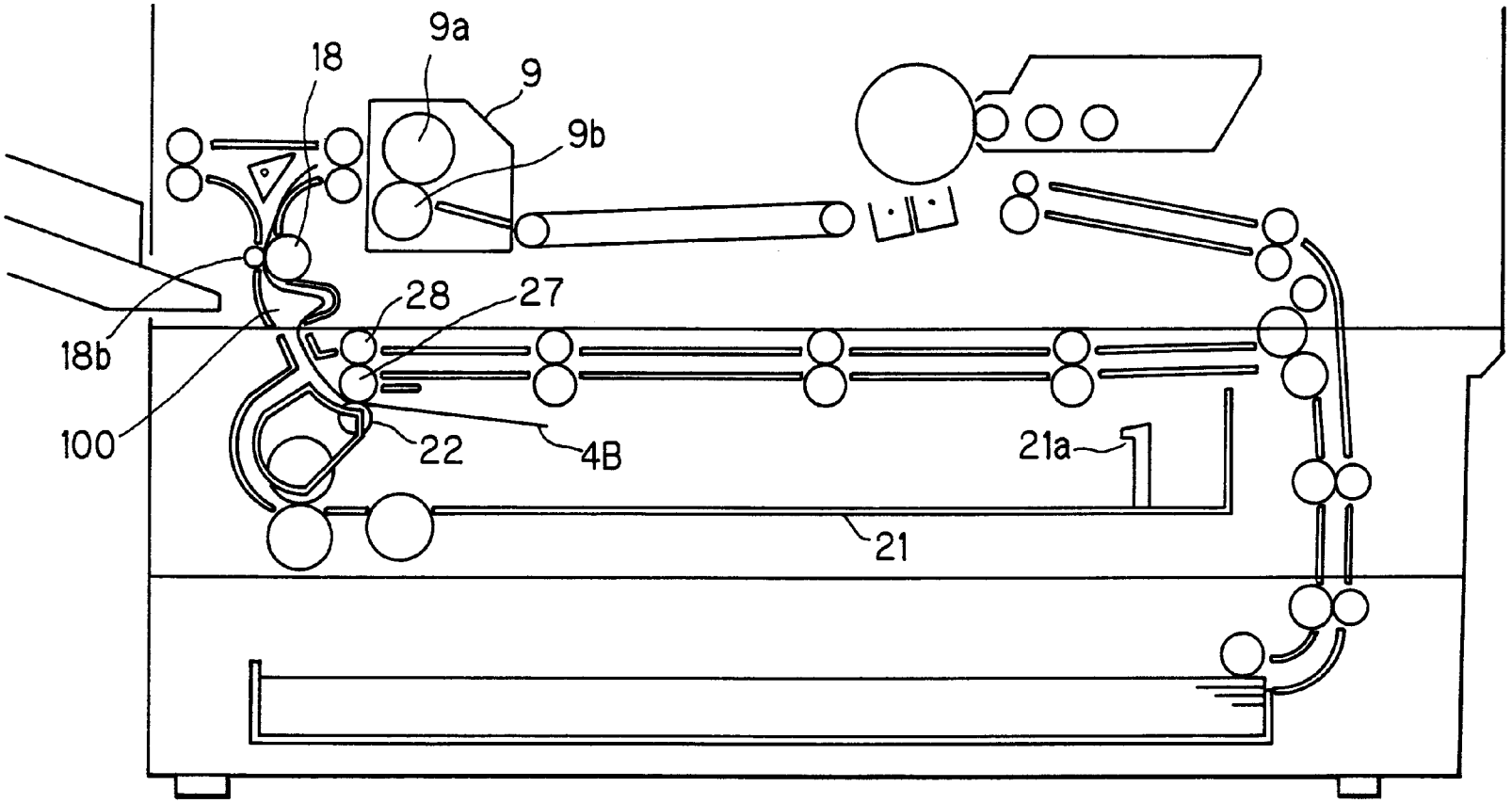
FIG. 6 is a diagram showing the operation with a sheet 4B in embodiment 1.

When a B-sized sheet 4B (its length in the conveying direction :L2 (L2<L1)) is conveyed along the path between de-curler rollers 18, 18*b* and the sheet input device of rollers 27, 22 to duplex printing tray unit 21 as an intermediate tray, the conveying speed of the sheet input device of rollers 27, 22 may be set at V2 (V2>V1). In this way, it is also possible as shown in FIG. 6 to have the B-sized sheet curled with the same degree of curling as that formed (with its imaged side concave) when an A-sized sheet is curled into sheet bending portion 100 between de-curler rollers 18, 18*b* and the sheet input device of rollers 27, 22 to duplex printing tray unit 21, which is opposite to the curl set (with its imaged side convex) by inverting path 17.The conveying speed of a conveying roller, for example 22, is accomplished by a controlling means such as a controller 50 illustrated in FIG. 5.

FIG. 4 is a diagram showing a configuration around the duplex printing tray unit of the invention. FIG. 5 is a diagram showing the operation with a sheet 4A in the implementation of embodiment 1. FIG. 6 is a diagram showing the operation with a sheet 4B in the implementation of embodiment 1.

Next, the correction of curling by conveyance speed difference will be explained. The sheet heated by fixing rollers 9*a* and 9*b* is curled with its imaged side convex when the sheet is separated from fixing rollers 9*a* and 9*b*. This curl is further enhanced during passing through the inverting conveyance path extending from fixing unit 9 to intermediate tray unit 21.

To deal with this, two curl correcting means are provided between the inverting conveyance path between fixing unit 9 and intermediate tray unit 21 to correct the sheet curling by two steps. The first curl correcting means which is disposed in the inverting conveyance path near fixing unit 9 is a de-curler roller pair of rollers 18 and 18*b*. Roller 18 is a soft roller formed of a metal shaft with a relatively soft rubber layered formed thereon. Roller 18*b* is a hard roller formed of a metal shaft. Hard roller 18*b* which is arranged on the convex side of the inverting conveyance path is pressed in contact with soft roller 18 on the opposite side of the conveyance path forming a nip for bending the curled sheet in the opposite direction to that of the curling. The second curl correcting means is composed of the pair of de-curler rollers 18 and 18*b*, sheet bending portion 100 and a pair of sheet input rollers 22 and 27.

This second curl correcting means will hereinbelow be explained in detail. The second curl correcting means performs curl correction by setting the sheet conveying speed V1 of sheet input rollers 22 and 27 slower than the sheet conveying speed V0 of de-curler rollers 18 and 18*b*. That is, in this setting, the image formed side of the sheet is bent in the opposite direction to that of the curling, i.e., into sheet bending portion 100 provided in the sheet conveyance path between de-curler rollers 18, 18*b* and sheet input rollers 22, 27, thus the curl will be corrected.

Because of the difference in conveying speed between de-curler rollers 18, 18*b* and sheet input rollers 22, 27, the length of the sheet between de-curler rollers 18, 18*b* and sheet input rollers 22, 27 gradually becomes greater than the conveyance path length between de-curler rollers 18,18*b* and sheet input rollers 22,27 after when the front end of the sheet has been nipped between sheet input rollers 22 and 27. This means formation of a curled portion of the sheet in sheet bending portion 100. This bending becomes greater in proportion to the time of sheet conveyance.

When V0 represents the conveying speed of de-curler rollers 18, 18*b*, V1 the conveying speed of sheet input rollers 22, 27, L0 the conveyance path length between de-curler rollers 18, 18*b* and sheet input rollers 22, 27, ΔL the difference of the sheet length between de-curler rollers 18, 18*b* and sheet input rollers 22, 27 minus L0, tC the period of time from when the front end of the sheet reaches sheet input rollers 22, 27 to the time the rear end of the sheet is delivered out from de-curler rollers 22, 27, and LP is the length of the sheet itself in the conveying direction, ΔL and tC are expressed as follows:

$$\Delta L=(V0-V1)tC$$

$$tC=(LP-L0)/V0$$

From these two equations, the following relation is obtained:

$$V1/V0=(LP-L0-\Delta L)/(LP-L0)$$

For example, if a maximum bending of 20 mm high (ΔH=20 mm) 15 mm in width in the conveying direction (ΔB=15 mm) is formed, ΔL should be as long as about 12 mm. Now, suppose V0=133 mm/s and L0=60 mm, a comparison will be made between the case of a widthwise delivery of an A4 sized sheet (210 mm×297 mm) and the case of a widthwise delivery of a B5 sized sheet (182×257 mm). In the case of a widthwise delivery of an A4 sized sheet, V1 is calculated to be equal to 122.4 mm/s. In the case of a widthwise delivery of a B4 sized sheet, V1 is calculated to be equal to 112 mm/s. This calculation was made with the maximum bent amount equal, but the maximum bent amount may be changed as appropriate depending upon the sheet size, sheet fiber direction (the degree of curling differs depending upon the direction of the sheet fiber direction), sheet thickness, etc.

Figure 7A:
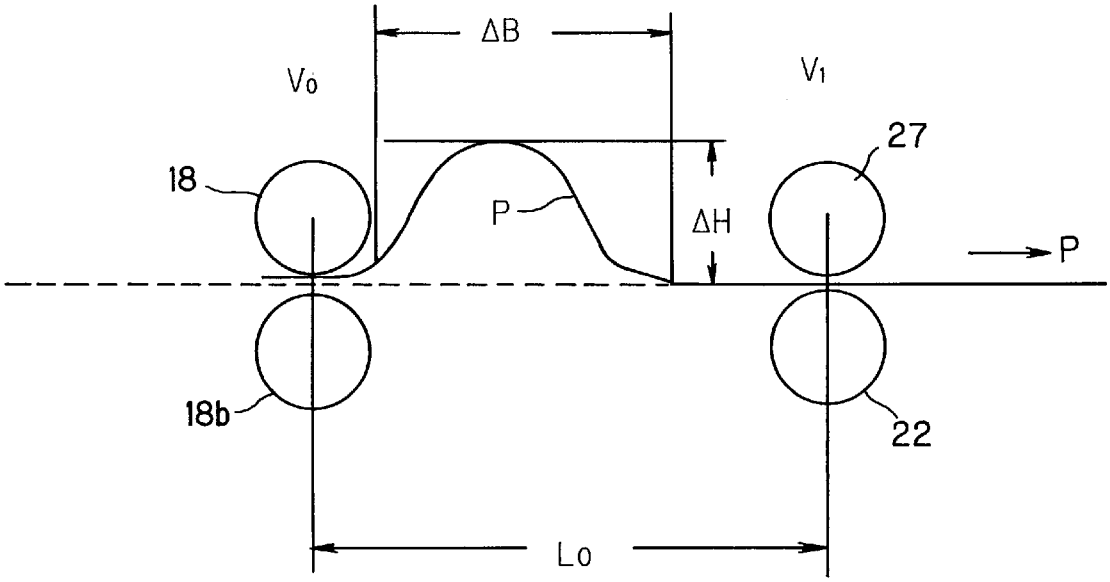
FIGS. 7A and 7B are diagrams for illustrating curl correction in accordance with embodiment 1.
Figure 7B:
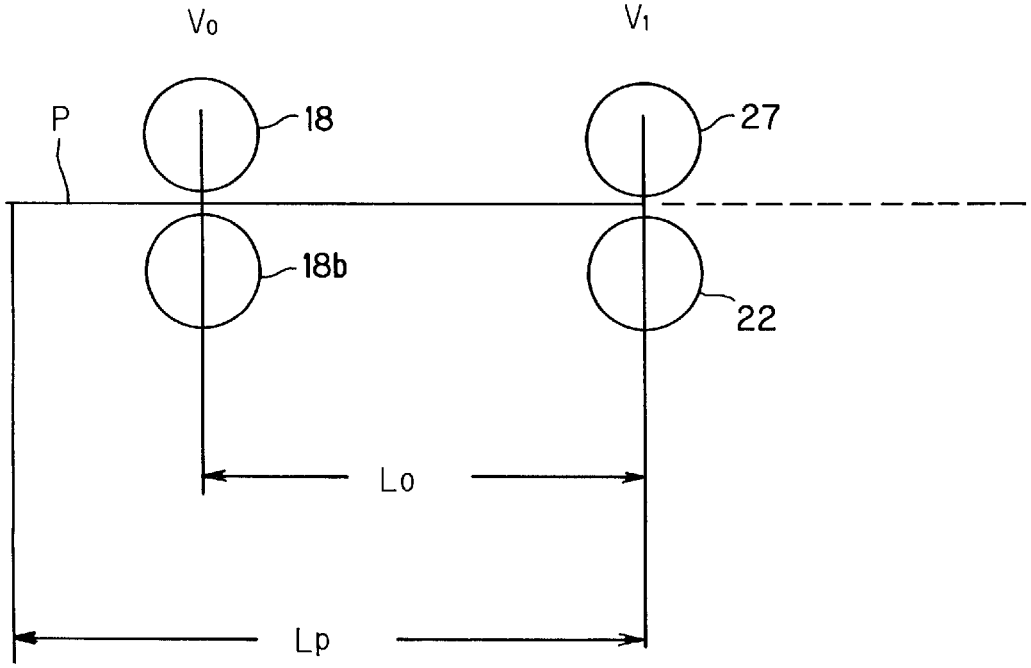

FIGS. 7A and 7B are diagrams explaining the correction of curling based on differential conveyance speed.

(Embodiment 2)

Figure 8A:
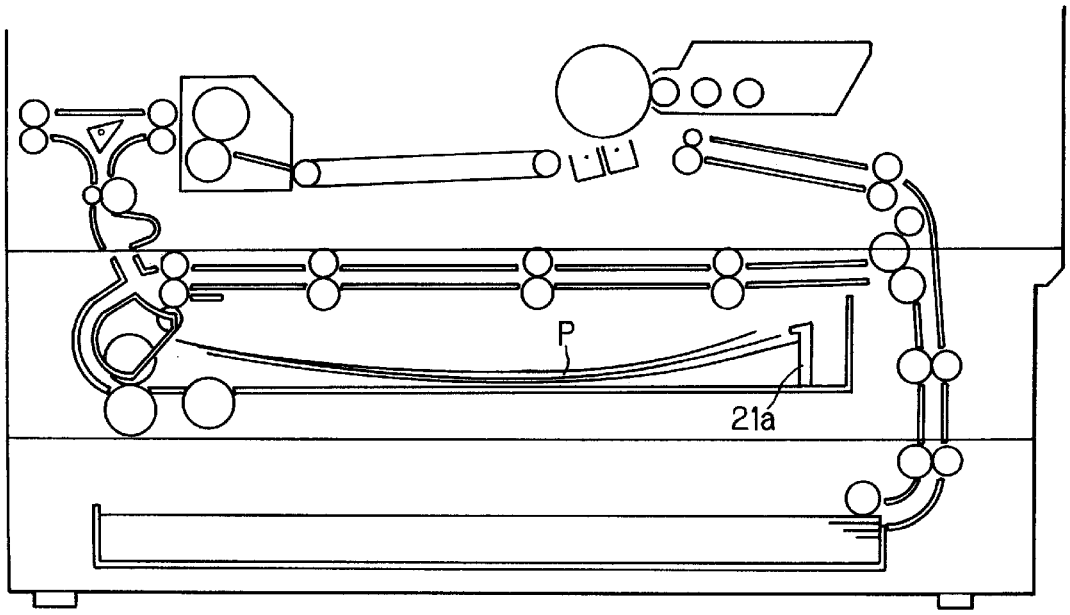
FIGS. 8A and 8B are diagrams showing the operation of the rear end plate in accordance with the second feature and embodiment 2.
Figure 8B:
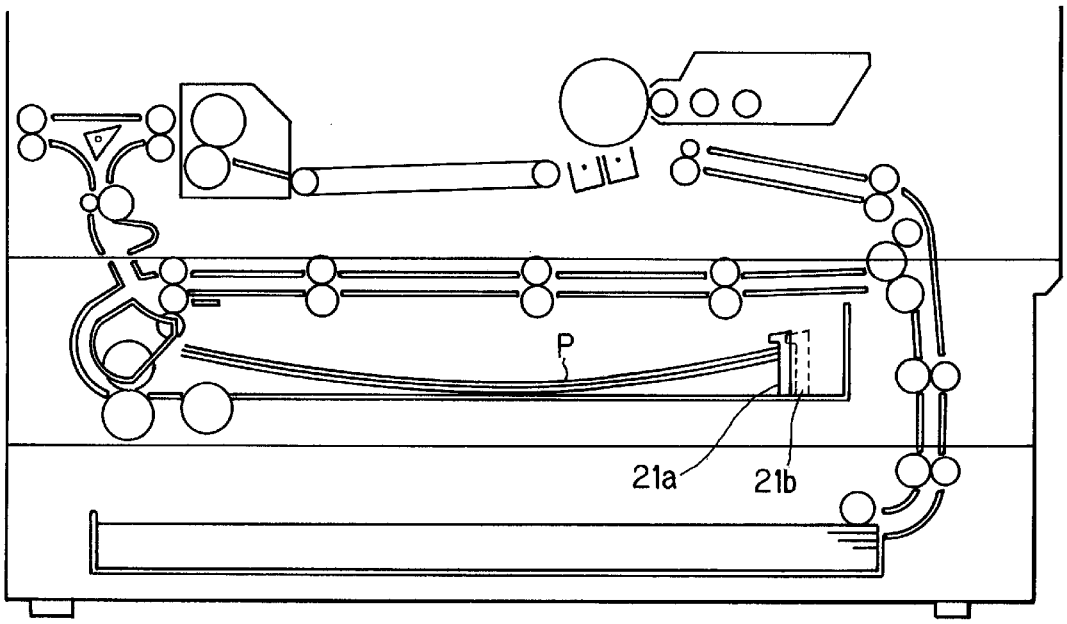

FIGS. 8A and 8B are diagrams showing the operation of rear end plate 21*a* in the second feature of the invention and in this embodiment 2. The following description will be made based on FIG. 8B.

In this embodiment, reduction of the sheet in its length in the sheet conveying direction due to sheet curling is to be measured previously, and rear end plate 21*a* is set up so as to move by the distance of the reduction from the nominal position of the front end of the sheet with respect to the sheet conveying direction to a displaced position toward the direction of sheet re-feeding. This setting enables appropriate alignment of sheets.

In FIG. 8B, rear end plate 21*a* is displaced from the position 'b' (before modification) to the position 'a' in the direction of sheet re-feeding, at which the ends of sheets P are aligned.

The invention should not be limited to the above described embodiments as shown with the drawings, but appropriate changes and modifications can be made without departing from the spirit and scope of the invention.

In accordance with the sheet feeding device for a duplex image forming apparatus of the above embodiment, the conveying speed of sheets is set lower for sheets having a shorter sheet length than for sheets having a longer sheet length, the following effects can be achieved. (1) The amount of the sheet curl formed at the rear end with respect to the sheet advancing direction can be regulated within a predetermined amount. As a result, when the input direction of sheets into the intermediate tray is opposite to the direction of the sheets re-fed therefrom, or elongated sheets are used, it is possible to gently correct the curl of sheets at the front end, and strongly and concentratedly correct that at the rear end. (2) Regardless of the size of paper, a required amount of a curl corrected portion for re-feeding can be secured at the rear end of the sheets immediately before the entrance to the duplex printing unit. Thus, a curl corrected portion can be provided concentratedly at the front end portion of sheets with respect to the re-feeding direction. Therefore, the whole length of an elongated sheet will not be excessively set in a bent state by the correcting force acting on the curl corrected portion. (3) Since the speed differential is set greater for a short sheet which is conveyed in a short period of time, it is possible to obtain a required amount of bending in a shorter period of time than that for a longer sheet. Thus, it is possible to create a desired amount of bending at the rear end of sheets which are short in length.

In the above way, regardless of the length of the sheet, it is possible to concentratedly correct the curling of sheets at the front portion thereof with respect to the sheet re-feeding direction, thus achieving a stable re-feeding operation of sheets.

In accordance with another embodiment of the sheet feeding device for a duplex image forming apparatus, if the length of sheets becomes substantially shorter due to sheet curl, the rear end plate can be designed to shift from a nominal position corresponding to the sheet length, to a displaced position toward the sheet front end adjuster. Thus, it is possible to appropriately align the placement of the sheets.

In accordance with still another embodiment of the sheet feeding device for a duplex image forming apparatus, depending upon the size of sheets, sheets having a shorter length are driven more slowly than those having a longer length. Therefore, regardless of the size of paper, a required amount of the curl corrected portion for re-feeding can be secured at the rear end of the sheets immediately before the entrance to the duplex printing unit. As a result, it is not necessary to greatly shift the rear end plate from a nominal position corresponding to the sheet length, to a displaced position toward the sheet front end adjuster. Thus, it is possible to avoid problematical cases such as that in which the position at which the rear end plate is placed in the case where the curl of sheets is appropriately corrected becomes different from that in which the position at which the rear end plate is placed in the case where the curl of sheets cannot be corrected well.

(Embodiment 3)

Next, the aforementioned sheet re-feeding device 20 will be described in detail with reference to FIGS. 9 through 11. This sheet re-feeding device 20 is provided between the image forming portion and cassette sheet feeder portion 13, as shown in FIG. 3.

Sheet re-feeding device 20 has an intermediate tray for having sheets P successively stacked one over another and accommodated therein and a sheet input roller 22 which is disposed at the upper portion of intermediate tray 21 to be connected to inverting path 17 on the copier body side and inputs sheets having images formed thereon, with formed images facedown, to intermediate tray 21. Intermediate tray 21 is arranged horizontally, accommodates sheets with formed images facedown by stacking one over another and has a stopper member 21*a* which regulates and aligns the front ends of sheets P flush with each other. Stopper member 21*a* can be moved left to right in FIG. 9 in accordance with the size of sheets, and is adjusted and positioned in accordance with the sheet size. A sheet feed roller 23 is provided in intermediate tray 21 so as to deliver out accommodated sheets P in the intermediate tray at a position corresponding to the front part thereof with respect to the sheet feeding direction, i.e., under the rear end of the sheets input by sheet input roller 22. This feed roller is arranged so that part of it projects from the level of the placement surface of intermediate tray 21.

Further, a sheet delivering roller 24 for delivering out sheets P is arranged in parallel on the sheet feeding side of sheet feed roller 23, and a separation roller 25 for stopping the upper sheets other than the lowermost sheet from being conveyed by sheet delivering roller 24 is provided in order to achieve sheet by sheet feeding. The sheet P conveyed by sheet delivering roller 24 is sent out to an inverting path 26 which is connected to re-conveyance path 19, which in turn joins conveyance path 14 to resist roller 7 disposed before the image forming position in the copier body.

Re-conveyance path 19 is formed in parallel with the placement surface of sheets P of intermediate tray 21, with a plurality of sheet conveying rollers 19*a* . . . , along the path. Provided at a connecting point between re-conveyance path 19 and inverting path 26 is a driving roller 27 for driving sheet input roller 22 which inputs sheet P with an image formed thereon into intermediate tray 21 as stated above. Further a sheet output roller 28 is provided so that it presses against driving roller 27 on the opposite side of sheet input roller 22.

Accordingly, sheet input roller 22 and sheet output roller 28 are driven rollers which are pressed against and rotate following the rotation of driving roller 27. The nip between sheet input roller 22 and driving roller 27 is arranged along the path from inverting path 17 to intermediate tray 21 of sheet re-feeding device 20. The nip between sheet output roller 28 and driving roller 27 is arranged along the path from inverting path 26 to re-conveyance path 19. Therefore, two conveyance paths, i.e., the sheet input path to intermediate tray 21 and the sheet output path for sheets P accommodated in intermediate tray 21 to be sent out are formed intersecting each other, and at the intersection, driving roller 27, sheet input roller 22 and sheet output roller 28 are arranged so that their nips lie along the respective sheet paths.

A conveying roller 29 for conveying sheets is provided on the opposite end of re-conveyance path 19 connected to inverting path 26, at the meeting point with conveyance path 14 in order to convey sheets P to resist roller 7 as stated above.

Next, description will be made of a sheet presser for pressing sheets P input into intermediate tray 21 and other mechanisms of the invention for preventing the sheets from curling and hence blocking a subsequent sheet.

A sheet feed guide 30 is provided having a guide surface for guiding sheets P to be input to intermediate tray 21 to the aforementioned nip between sheet input roller 22 and driving roller 27. This sheet feed guide 30, in addition to a guide surface 30*a* for guiding sheets P input to intermediate sheet tray 21, has a slanted guide surface 30*b* which inclines so as to guide the front end, with respect to the re-feeding direction, of the sheets accommodated in intermediate tray 21 to sheet delivering roller 24, and an inverting guide surface 30*c* for inverting path 26 which is connected to re-conveyance path 19.

Provided in sheet feed guide 30 is a lift stopper member 31 for preventing the rear end of sheet P from lifting due to curling above the nip between sheet input roller 22 and driving roller 27 when sheet P has been input into intermediate tray 21. This stopper member 31 is formed as to be angled in an open V shape, and has an axle 32 at its angled portion to allow itself to pivot about the shaft.

Figure 10:
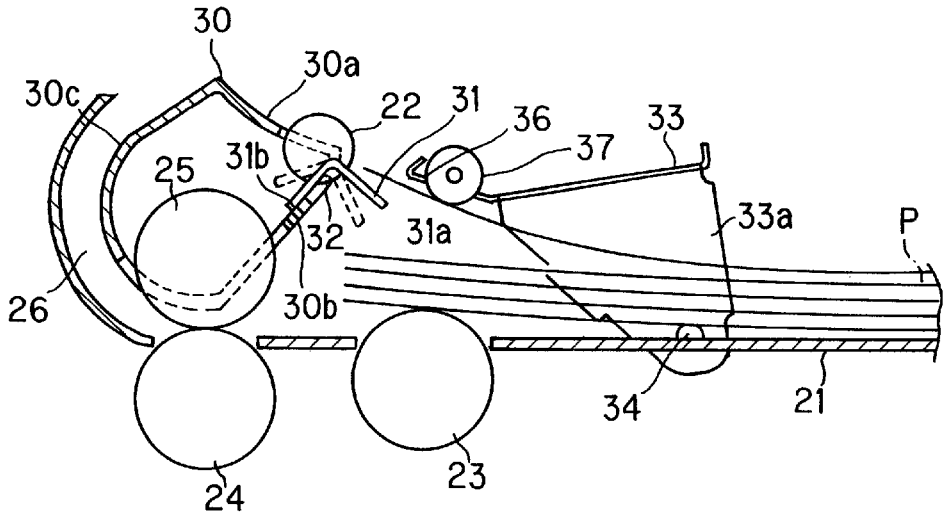
FIG. 10 is a partially enlarged view for illustrating collection of sheets with one side printed into an intermediate tray and re-feeding of the collected sheets.

Lift stopper member 31 is usually positioned at the position indicated by the solid line in FIG. 10, and is rotated clockwise in the figure to the position shown by the dashed line when the rear end of a sheet P is pressed down. When the urged state is released, the stopper member reverts back to the position shown by the solid line. Lift stopper member 31 is rotatably supported at its axle 32 by sheet feed guide 30.

Lift stopper member 31 of the invention is composed of two sides; the side which faces the rear end of sheet P in the input direction forms a lift stopper portion 31*a* while the opposite side forms a balancer portion 31*b* for reverting lift stopper member 31 to the original position, i.e., the position shown in FIG. 10. Accordingly, the center of gravity of lift stopper member 31 is located on the left side in FIG. 10 because of balancer 31 *b*, so as to rotationally urge lift stopper member 31 in the counterclockwise direction. Therefore, balancer 31*b* abuts the opposite surface of sheet guide 30 on slanted guide surface 30*b*, so that the lift stopper member is positioned at the position indicated by the solid line.

Sheet feed guide 30 also rotatably supports sheet input roller 22, which is configured to press itself against driving roller 27. In particular, lift stopper member 31 is located at a site below the nip between sheet input roller 22 and driving roller 27. In this example, axle 32 is positioned below the rotary shaft of sheet input roller 22, or on the side nearest intermediate tray 21. In this arrangement, when the rear end of a sheet P is placed below lift stopper portion 31*a* of lift stopper member 31, the rear end of the sheet P can be prevented from popping up above the nip between sheet input roller 22 and driving roller 27.

In addition to lift stopper member 31, a presser member 33 for pressing down the rear end of sheet P input by sheet input roller 22 to intermediate tray 21 from above is provided rotatably. This presser member 33 has supported portions 33*a* formed at both sides as shown in FIG. 11, which are rotatably supported at a shaft 34 by the side frames of the copier body.

Presser member 33 comprises a presser end 35 for pressing the rear end of sheet P, at its front end or at its free end which opposes the sheet input roller 22, and a pressing roller 36 rotatably supported and positioned in association with presser end 35. This pressing roller 36 is arranged so as to abut sheet feed roller 23 on the intermediate tray 21 side when it is rotated toward intermediate tray 21 by a driving force from an unillustrated urging means such as a solenoid or the like. Hence presser end 35 can rotate and urge the rear end of sheet P onto intermediate tray 21 from above.

Presser end 35 is arranged in such a relationship that its front end will not come in contact with lift stopper member 31. As shown in FIG. 11, a pair of presser ends 35 are disposed apart from each other at a distance across the width of presser member 33 (the direction perpendicular to the sheet conveying direction) shorter than the width of the minimum sheet size to be used. Further, a pair of lift stopper members 31 are also arranged apart from each other at a distance shorter than the minimum sheet width. In this way, presser ends 35 are provided so as to press down a minimum size sheet P while lift stopper portions 31*a* of lift stopper members 31 are provided so that the rear end of sheet P which has been pressed down by presser ends 35 will not pop up.

Figure 11:
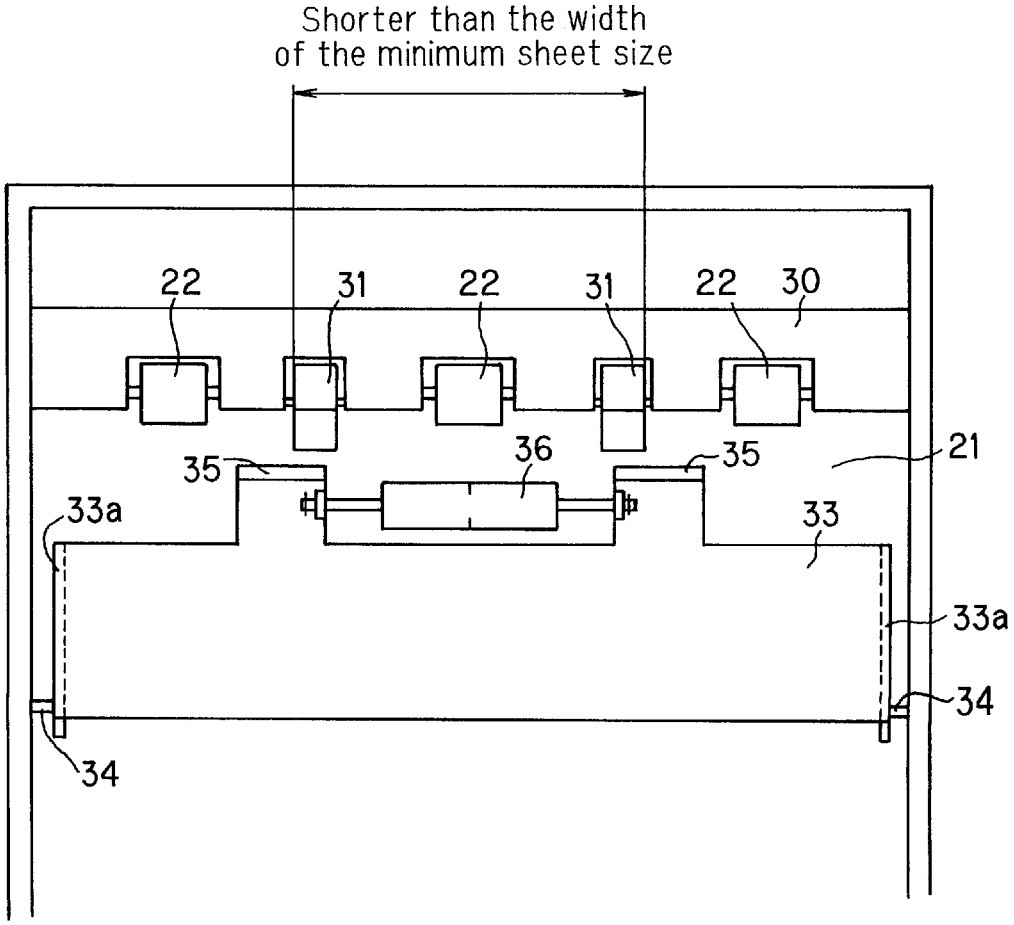
FIG. 11 is a plan view of the device of FIG. 10 viewed from above.

Although in FIG. 11 a pair of lift stopper members 31 are provided on both sides with respect to the center of the sheet to be input, only one lift stopper member may be provided at the center. Further, concerning presser end 35, when one lift stopper member 31 is provided, a pair of presser ends 35 may be arranged on both sides of the lift stopper member. Since this arrangement can avoid lift stopper member 31 and presser end 35 contacting each other, lift stopper portion 31*a* and presser end 35 can be prevented from interfering with each other, and can return to their original states even if both the members are mutually projected as in FIG. 11. As a result, it is possible to further make presser end 35 longer so as to press the rear end of sheet P more efficiently.

Figure 9:
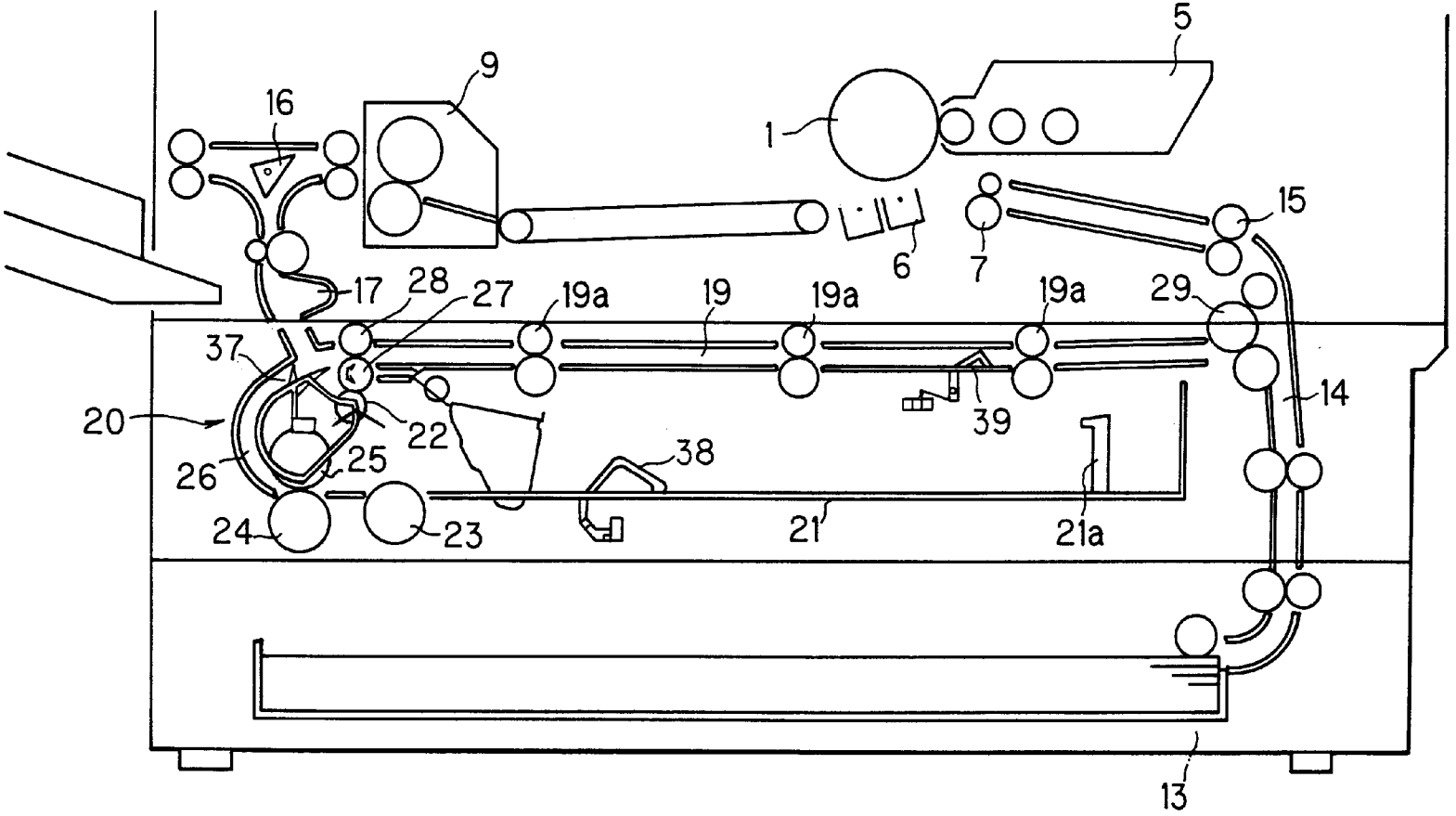
FIG. 9 is a sectional view showing an overall configuration of a sheet re-feeding device of the invention.

In FIG. 9, designated at 37 is an actuator which is actuated to detect a sheet to be guided toward sheet input roller 22 and detect a sheet to be delivered out from inverting path 26 to re-conveyance path 19. That is, an actuation of this actuator means the detection of the front end of a sheet. Reference numeral 38 designates an actuator which is actuated by a sheet being stacked on intermediate tray 21 to detect the existence of stacked sheets. Numeral 39 designates an actuator which is actuated by a sheet being conveyed through re-conveyance path 19, in particular to detect a sheet before it joins to conveyance path 14.

(Description of the Operation of Inputting Sheets to the Intermediate Tray)

Next, in the thus configured sheet re-feeding device 20, the operation for collecting a sheet P with an image formed thereon into intermediate tray 21 will be described.

Sheet P with an image formed by the copier is guided to inverting path 17 by means of switching gate 16 when duplex printing is performed. When this sheet P is input into inverting path 17, it is guided along input guide surface 30*a* of sheet feed guide 30 to the nip between input roller 22 and driving roller 27. Then, sheet P held between the nip, is conveyed by the driving force of driving roller 27 rotating counterclockwise and input to intermediate tray 21. In this case, presser member 33 is located at the position shown in FIG. 9. Therefore, sheet P enters intermediate tray 21 with its front end sliding along the sheet placement surface, and is stopped being conveyed further by stopper member 21*a*.

In this state, the rear end of sheet P leaves the nip between input roller 22 and driving roller 27 and falls down to intermediate tray 21 due to gravity. However, if the sheet has a strong curl, the rear end of sheet P may stay at a higher position than the nip between input roller 22 and driving roller 27. To deal with such a situation, when the rear end of the sheet has left input roller 22, presser member 33 is rotated counterclockwise in FIG. 9 so that presser end 35 urges the rear end of sheet P down toward intermediate tray 21 from the state shown in FIG. 12 A to the state shown in FIG. 12B. At this moment, the rear end of the sheet rotates lift stopper member 31 clockwise and when the rear end of sheet P passes by a point, the lift stopper member reverts back to the original position indicated by the solid line in FIG. 10 due to gravity or due to the function of balancer portion 31*b*.

Accordingly, the rear end of sheet P is positioned below lift stopper member 31 as shown in FIG. 10. Therefore, if sheet P has a strong curl at its rear end, a further pop-up can be stopped by lift stopper portion 31*a* of lift stopper member 31, so that no preceding sheet will hinder a following sheet P which is being input into intermediate tray 21 by input roller 22.

The rear end of the sheet is pressed down below lift stopper member 31 by the rotation of presser member 33, the presser member is released from the urged state reverting back to the original state shown in FIG. 9 for preparation of the next sheet P to be fed into intermediate tray 21.

The above sequence of operations is repeated, and sheets P with an image formed thereon are successively stacked onto intermediate tray 21. During this operation, the front ends of sheets P are aligned in flush by stopper member 21*a*, while the rear ends of sheets P are stopped from popping up by means of lift stopper member 31, specifically by lift stopper portion 31*a*, even if they tend to pop up due to curl or other reasons. Resultantly, the front end of sheet P being input into intermediate tray 21 will not be hindered by the rear end of the curled sheets already accommodated therein. Further, if a greater number of sheets were stacked and the acting force due to curl built up, the rear end of sheets P would not pop up above the position of lift stopper portion 31*a* of lift stopper member 33, indicated by the solid line.

Further, when the sheets are re-fed from intermediate tray 21, the rear end of the sheet, or the front end of sheet P with respect to the re-feeding direction will not snag slanted guide surface 30*b* of sheet feed guide 30, causing improper sheet feeding. In particular, during sheet re-feeding, a stack of sheets on intermediate tray 21 as shown in FIG. 12B is pressed against sheet feed roller 23 by presser roller 36 of presser member 33 as shown in the drawing. Therefore, curled sheets P are kept away from slanted sheet guide surface 30*b* and the sheets are successively delivered out from the lowermost one, then the sheets pass through feed roller 23 and sheet delivering roller 24 and further advances along re-conveyance path 19 reaching resist roller 7.

Figure 12A:
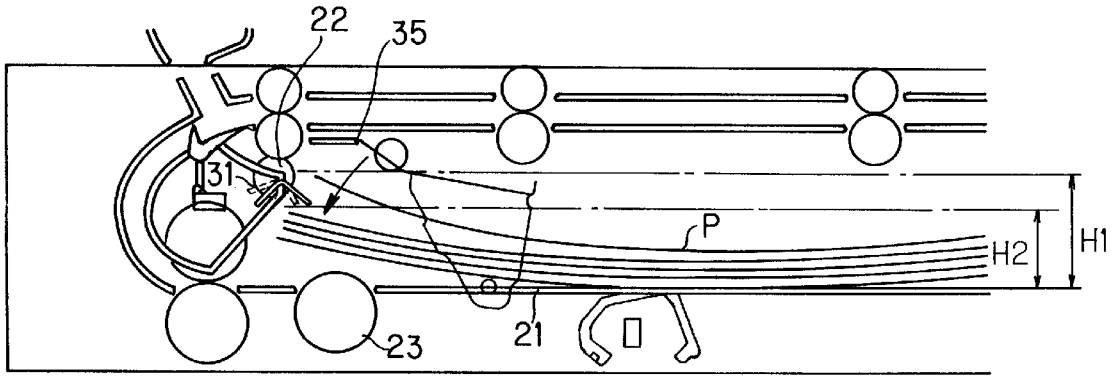
FIGS. 12A and 12B are diagrams for illustrating how the sheet re-feeding device of the invention collects sheets into the intermediate sheet tray and re-feed the collected sheet therefrom.
Figure 12B:
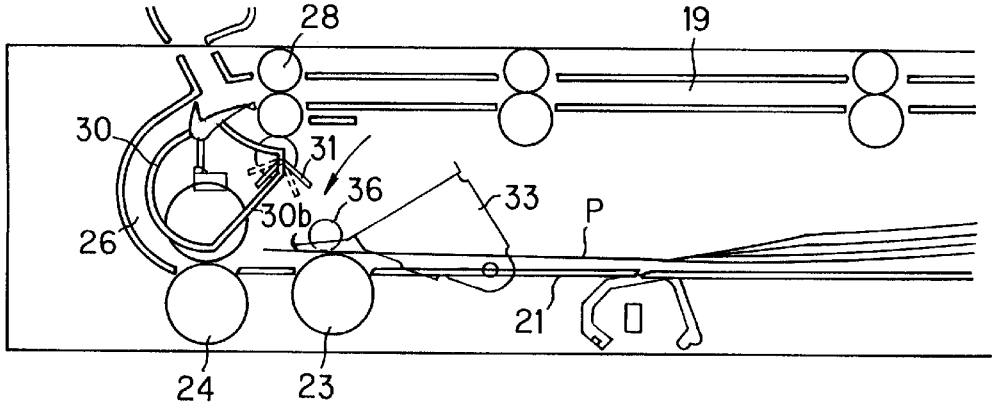

Due to the curl of the sheets, the rear end of a sheet inherently stays higher than a height H1, as shown in FIG. 12A, which impedes the input operation of the next sheet. In this invention, the provision of lift stopper member 31 and the operation of presser member 33 position the topmost sheet P below lift stopper member 31, hence the height can be reduced to H2 or less. Accordingly, as long as a sheet P is conveyed with its front end thereof equal to or higher than height H1, a sheet P being conveyed can be input reliably to intermediate tray 21 by reducing the height of the rear end of the topmost sheet to a height of H2 or less from a state where the input operation of a sheet is impeded and normal input operation cannot be performed. Moreover, as the stacked amount of sheets P increases, the height will not be greater than height H2. Of course, in this case the thickness of a sheet needs to be equal to or less than height H2.

Rotation of presser member 33 is started at a timing delayed to some degree after the rear end of sheet P has been detected by actuator 37 provided before input roller 22. This setting allows presser end 35 to reliably press down the rear of the sheet when the rear end of sheet P has passed through input roller 22.

In addition, presser roller 36 is provided so as to move up and down in order to feed sheets P accommodated in intermediate tray 21. This mechanism of up-and-down movement is made use of to construct the aforementioned presser mechanism for pressing the rear end of sheets P. So, providing a presser roller 36 for presser member 33 negates the need to provide a particular device for pressing down the rear end of the sheets, hence existing presser roller 36 can be used as the device to be pressed against sheet feed roller 23 and can also be shared by presser member 33.

Figure 13A:
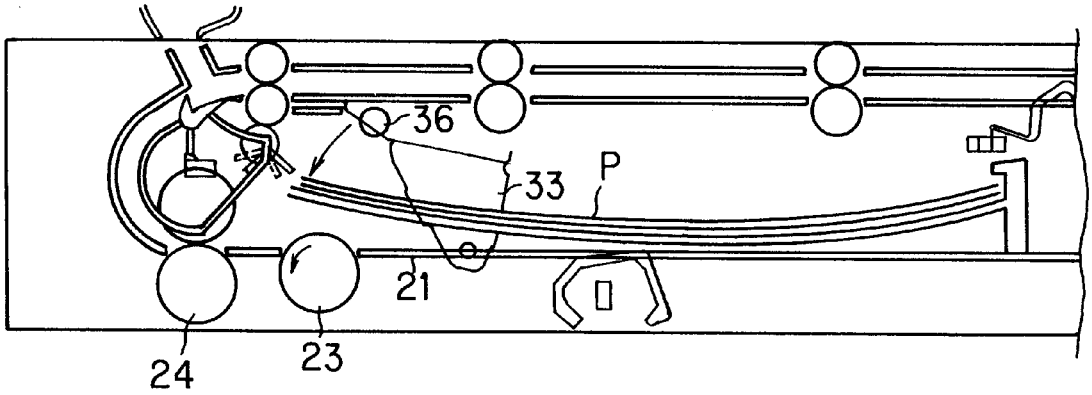
FIGS. 13A and 13B are diagrams showing a configuration of the invention which achieves an improved collecting operation of sheets.
Figure 13B:
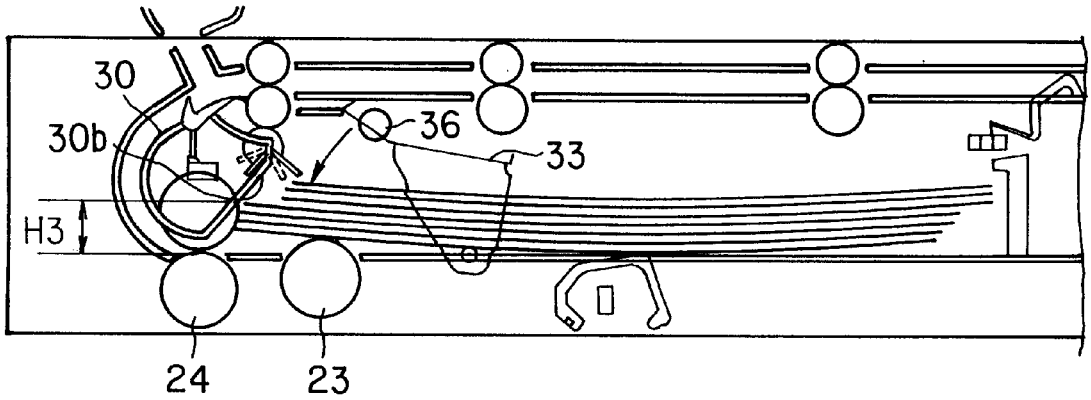

Referring next to FIGS. 13A and 13B, an improved configuration of intermediate tray 21 for accommodating sheets P with an image formed thereon and its operation will be described.

As an example, this configuration achieves an improved accommodation of sheets P after intermediate tray 21 has already had half the maximum capacity of sheets stacked thereon. In particularly, when the rear ends of sheets P are strongly curled, the topmost sheet P may constantly come in contact with the underside of lift stopper member 33. In this case, it is conceived that both sides (with respect to the width ) of sheet P may be curled upward at its rear end and hence jut up higher to some degree than lift stopper member 31. This tendency becomes more noticeable as the amount of stacked sheets increases.

To deal with this, when the number of collected sheets P in intermediate tray 21 is half the maximum number (N) of capacity of sheets (N/2), presser member 33 is rotated as shown in FIG. 13A to press down the sheets accommodated in intermediate tray 21 from above. At this moment, presser roller 36 is put in contact with sheet feed roller 23 so that the stacked sheets P are held between the two rollers. In this condition, sheet feed roller 23 is driven at the order of some hundreds of msec. This operation causes the whole of the stacked sheets to be fed toward sheet delivering roller 24 along the slanted guide surface 30*b* of sheet feed guide 30. As a result, the rear ends of the sheets, i.e., the front ends of the sheets with respect to the direction of sheet re-feeding from intermediate tray 21 can be separated along slanted guide surface 30*b* and move as shown in FIG. 13B. Accordingly, the height is reduced to H3. Consequently, even when the rear end of the topmost sheet is arched upward at its both sides, the sheet will not snag the front end of a subsequent sheet P being input and hinder its entrance.

Sheet feed roller 23 starts to be driven at a timing when the number of the sheets in intermediate tray 21 becomes equal to half the maximum capacity N (i.e., N/2), that is, this can be implemented based on the count (N/2) using a counter which counts the number of the input detection of actuator 37. For this operation, presser member 33 is rotated so that presser roller 36 is pressed in contact with sheet roller 23, and in this condition, sheet feed roller 23 will be driven during the aforementioned period.

Figure 14A:
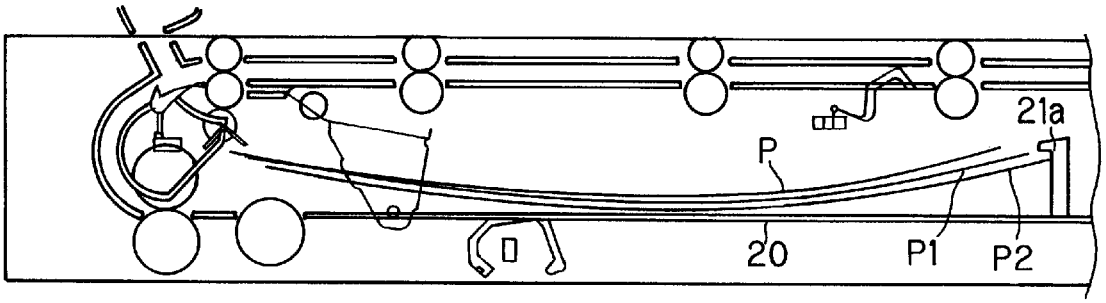
FIGS. 14A and 14B are diagrams showing another configuration of the invention which achieves an improved collecting operation of sheets.
Figure 14B:
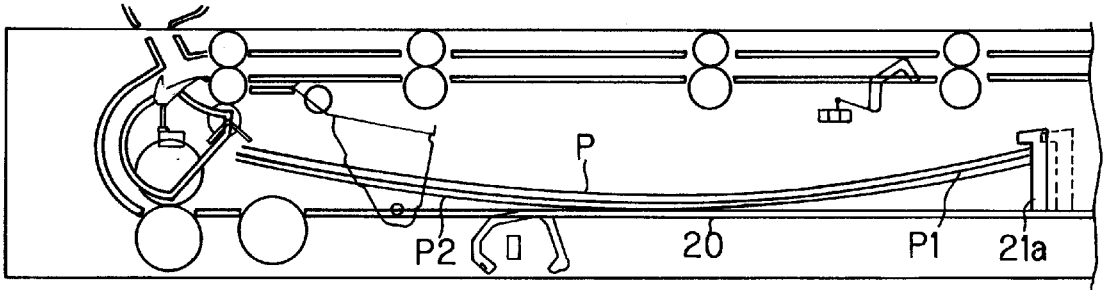

Since the sheets accommodated in intermediate tray 21 have differing sheet curls, the previously accommodated sheets may be pushed by a subsequently input sheet so that the front ends of the sheets thus collected will not be aligned in flush with each other and the lowermost sheet might be displaced from the operative area of sheet feed roller 23 for sheet feeding. Referring now to FIGS. 14A and 14B, a method of eliminating this failure will be described.

As shown in FIG. 14A, a sheet P being input acts to further push sheets P1 and P2 already collected inside intermediate tray 21. Although stopper member 21*a* stops the sheets from being pushed further, the lowermost sheet P2 is positioned at the boundary where sheet feed roller 23 acts. To deal with this, stopper member 21*a* is previously set at a suitable position for the sheet size to be used as shown in FIG. 14B, from the position shown by the broken line. It is also possible to shift stopper member 21*a* from the position of the broken line to the position shown by the solid line whenever a sheet is input and then shift it back to the position of the broken line after sheets P are aligned in flush.

In this way, it is possible to eliminate the cause of sheet feed failure of sheets P1, P2 which reside at the bottom, thus achieving a reliable sheet re-feeding operation.

In accordance with the sheet re-feeding device of the invention, when a sheet with an image formed thereon is input temporarily into the intermediate tray, the sheet can be reliably input thereonto without being impeded by the sheets which have been already input therein.

Even when sheets have strong curls, the height of the stacked sheets will not exceed a predetermined level. As a result, it is possible to reliably input a subsequent sheet to the intermediate tray, and further the sheet re-feeding from the intermediate tray can be performed without causing improper sheet re-feeding.

Particularly, in accordance with the invention, the device can achieve the above remarkable effects by an extremely simple configuration without the necessity of creating a special structure of the sheet presser.

What is claimed is:

1. An intermediate sheet feeding device for a duplex image forming apparatus, which makes an image processing portion form an image on one side of a sheet, collects the sheet with an image formed on one side thereof in an intermediate tray, and re-feeds the one side printed sheet to form an image on the other side thereof, comprising:

an intermediate tray;

a sheet input conveyance path to the intermediate tray;

a sheet output conveyance path from the intermediate tray; the sheet input conveyance path and the sheet output conveyance path being arranged to intersect each other at one end of the intermediate sheet tray;

a conveying roller provided along the conveyance path from the image processing portion to the intermediate tray; and a conveyance controlling means which controls the conveying roller so as to convey the sheet at a speed lower than that when the sheet advances through the image processing portion and controls the speed of a short-sized sheet at a first speed which is slower than a second speed which is the speed of a long-sized sheet.

2. An intermediate sheet feeding device for a duplex image forming apparatus, which makes an image processing portion form an image on one side of a sheet, collects the sheet with an image formed on one side thereof in an intermediate tray, and re-feeds the one side printed sheet to form an image on the other side thereof; comprising:

an intermediate tray;

a sheet input conveyance path to the intermediate tray;

a sheet output conveyance path from the intermediate tray; the sheet input conveyance path and the sheet output conveyance path being arranged to cross each other at one end of the intermediate sheet tray;

a conveying roller provided along the conveyance path from the image processing portion to the intermediate tray; and means between the conveying roller and the image processing portion for curling the sheets, wherein the position of sheets when sheets are input into the intermediate tray is shifted by a prescribed distance from a position determined by the actual length of the sheets in the sheet re-feeding direction so as to regulate the sheets during the sheet input operation as well as during the sheet re-feeding operation.

3. An intermediate sheet feeding device for a duplex image forming apparatus according to claim 2, further comprising a conveyance controlling means which controls the conveying roller so as to convey the sheet at a speed lower than that when the sheet advances through the image processing portion and controls the speed of a short-sized sheet at a first speed which is slower than a second speed which is the speed of a long-sized sheet.

4. An intermediate sheet feeding device for a duplex image forming apparatus, which makes an image processing portion form an image on one side of a sheet, collects the sheet with an image formed on one side thereof in an intermediate tray, and re-feeds the one side printed sheet to form an image on the other side thereof, comprising:

a sheet input roller for inputting the sheet with an image formed thereon into the intermediate tray;

a presser member for pressing down the sheet input by the sheet input roller at one end thereof onto the intermediate tray; and a lift stopper member disposed at a position below the sheet input roller and corresponding to one end of the input sheet to be collected in the intermediate tray and operating so as to be positioned on the top of the sheet end when the sheet presser presses down the end of the sheet;

wherein the lift stopper member is fixedly disposed underside of the sheets as the sheets are delivered by the input roller toward the intermediate tray and the lift stopper member is located above the sheets when the sheets are pressed by the pressing member.

5. An intermediate sheet feeding device for a duplex image forming apparatus according to claim 4, wherein sheets input into the intermediate tray are delivered out starting with the bottom-out sheet.

6. An intermediate sheet feeding device for a duplex image forming apparatus, which makes an image processing portion form an image on one side of a sheet, collects the sheet with an image formed on one side thereof in an intermediate tray, and re-feeds the one side printed sheet to form an image on the other side thereof, comprising:

a sheet input roller for inputting the sheet with an image formed thereon into the intermediate tray;

a presser member for pressing down the sheet input by the sheet input roller at one end thereof onto the intermediate tray; and a lift stopper member disposed at a position below the sheet input roller and corresponding to one end of the input sheet to be collected in the intermediate tray and operating so as to be positioned on the top of the sheet end when the sheet presser presses down the end of the sheet;

wherein the lift stopper member has a lift stopper portion which is pivotally provided at an axle and sways when one end of the sheet is pressed down and which is positioned so that the sheet end stays therebeneath when the lift stopper portion reverts back to the original position.

7. An intermediate sheet feeding device for a duplex image forming apparatus according to claim 6, wherein the lift stopper member has a balancer portion which sets the center of gravity of the lift stopper member toward the opposite side of the lift stopper member so that the lift stopper member will revert back to the original position after it is pressed down by one end of a sheet.

8. An intermediate sheet feeding device for a duplex image forming apparatus which makes an image processing portion form an image on one side of a sheet, collects the sheet with an image formed on one side thereof in an intermediate tray, and re-feeds the one side printed sheet to form an image on the other side thereof, comprising:

a sheet input roller for inputting the sheet with an image formed thereon into the intermediate tray;

a presser member for pressing down the sheet input by the sheet input roller at one end thereof onto the intermediate tray; and a lift stopper member disposed at a position below the sheet input roller and corresponding to one end of the input sheet to be collected in the intermediate tray and operating so as to be positioned on the top of the sheet end when the sheet presser presses down the end of the sheet;

wherein the presser member has an end pressing down one end of sheets and a presser roller for pressing the collected sheets against a sheet feed roller for re-feeding the sheets collected in the intermediate tray.

* * * * *